US006119774A

United States Patent [19]

Doane et al.

[11] Patent Number: 6,119,774

[45] Date of Patent: Sep. 19, 2000

[54] CAGED SLIP SYSTEM

[75] Inventors: James C. Doane, Friendswood; Henry Joe Jordan, Jr., Conroe; Hector H. Mireles, Jr., Spring, all of Tex.

[73] Assignee: Baker Hughes Incorporated, Houston, Tex.

[21] Appl. No.: 09/120,054

[22] Filed: Jul. 21, 1998

[51] Int. Cl.[7] ..... E21B 23/01

[52] U.S. Cl. ..... 166/134; 166/137; 166/216; 166/217; 175/230

[58] Field of Search ..... 175/230; 166/125, 166/134, 137, 215–217

[56] References Cited

U.S. PATENT DOCUMENTS

| | | | |
|---|---|---|---|
| 4,224,987 | 9/1980 | Allen | 166/120 |
| 4,432,418 | 2/1984 | Mayland | 166/133 |
| 4,702,313 | 10/1987 | Greenlee et al. | 166/216 |
| 4,750,559 | 6/1988 | Greenlee et al. | 166/216 |
| 5,193,620 | 3/1993 | Braddick | 166/382 |
| 5,350,013 | 9/1994 | Jani et al. | 166/217 |
| 5,555,946 | 9/1996 | Klatt | 175/61 |

*Primary Examiner*—Roger Schoeppel
*Attorney, Agent, or Firm*—Duane, Morris &Heckscher LLP

[57] ABSTRACT

An improved cage slip system is disclosed. The cage is constructed so that the cones which actuate the slips extend into the cage openings. The radial extension of the slips is limited so as to retain them if they are extended in an unsupported situation. The cones have a maximum outside dimension equal to the outside dimension of the cage so as to increase the rating of the slips by increasing the bearing area of the cones on the slips. The beneficial features of the cage design are retained while a greater degree of radial expansion of the slips is possible allowing minimization of tool inventory for situations where a lighter wall casing requires further slip extension.

17 Claims, 6 Drawing Sheets

CAGED SLIP SYSTEM

FIELD OF THE INVENTION

The field of this invention relates to retention devices for downhole tools, particularly slip systems located in cages.

BACKGROUND OF THE INVENTION

Slips are used in downhole tools such as packers to retain the position of the tool. Slips can be provided in a cage where a sleeve has openings through which the slips extend, separated by structural components of the cage to give it the integrity needed to withstand forces applied during the operation of the tool. These conventional caged slip systems offer protection to the slips while running in the hole. Apart from protecting the slips during run-in, the cage itself typically serves as a pickup device when retrieving slips. One of the design drawbacks of existing caged slip systems is a limitation on the extendable diametrical range of the slips. The longitudinal elements which define the openings through which the slips extend also serve as travel stops. Since these longitudinal components require a predetermined structural strength, they cannot be thinned to allow additional slip extension. This concept is illustrated in FIG. 1 which shows the prior art. In FIG. 1 a prospective view of a slip 10 is shown. The cross-section of the slip 10 is U shaped and the longitudinal strip 12 extends within the U and acts as an outward travel stop for the caged slip 10. The openings or windows 14 are defined between the longitudinal strips 12. Accordingly, in the prior art, the requisite thickness of the longitudinal strips 12 limited the amount of outward travel of the slips 10. Additionally, in the prior art designs, the cones which would force the slips outwardly were located inside the cage as represented graphically by arrow 16. One such product is the Model SC-2P retrievable packer made by Baker Oil Tools. The placement of the cones within the cage defined by longitudinal members 12 reduced the available bearing area of the cones on the slips and therefore limited the capacity of the slips to resist differential forces which are present in the wellbore. Thus, these two significant limitations of prior caged slip designs amounted to lower performance ratings of the overall tool, as well as the need to have more tools available for varying sizes of casing. The reason for this was that depending on the casing weight per foot, its inside dimension would vary. Thus, different tools might be needed in the prior art to extend sufficiently far if lighter wall casing was in use.

Thus, some of the objects of the present invention are to allow greater extension of the slips while retaining or expanding the ability of the slip system to withstand differential loads. Additionally, another objective is to allow within a given tool body size sufficient rangeability and slip extension so as to avoid stocking a large inventory of tools to handle a variety of situations. Another objective is to uniquely position the cone within the openings of the cage so that the cones extend outwardly as far as the outer extremity of the cage. All this is accomplished while at the same time retaining the beneficial qualities of a caged slip during run-in. Another objective, which is accomplished by putting the cones in the windows of the cage, allows the cage thickness to be increased to improve its tensile strength without reduction of the amount of slip extension. Finally, another objective is to be able to retain the slips to a predetermined extension diametrically outwardly. Thus, the slips are limited in radial extension to prevent them from escaping the cage if they are extended in an unsupported condition. Those and other features of the present invention will become more apparent to those skilled in the art from a review of the preferred embodiment described below.

SUMMARY OF THE INVENTION

An improved cage slip system is disclosed. The cage is constructed so that the cones which actuate the slips extend into the cage openings. The radial extension of the slips is limited so as to retain them if they are extended in an unsupported situation. The cones have a maximum outside dimension equal to the outside dimension of the cage so as to increase the rating of the slips by increasing the bearing area of the cones on the slips. The beneficial features of the cage design are retained while a greater degree of radial expansion of the slips is possible allowing minimization of tool inventory for situations where a lighter wall casing requires further slip extension.

DETAILED DESCRIPTION OF THE PREFERRED EMBODIMENT

Figure 2:
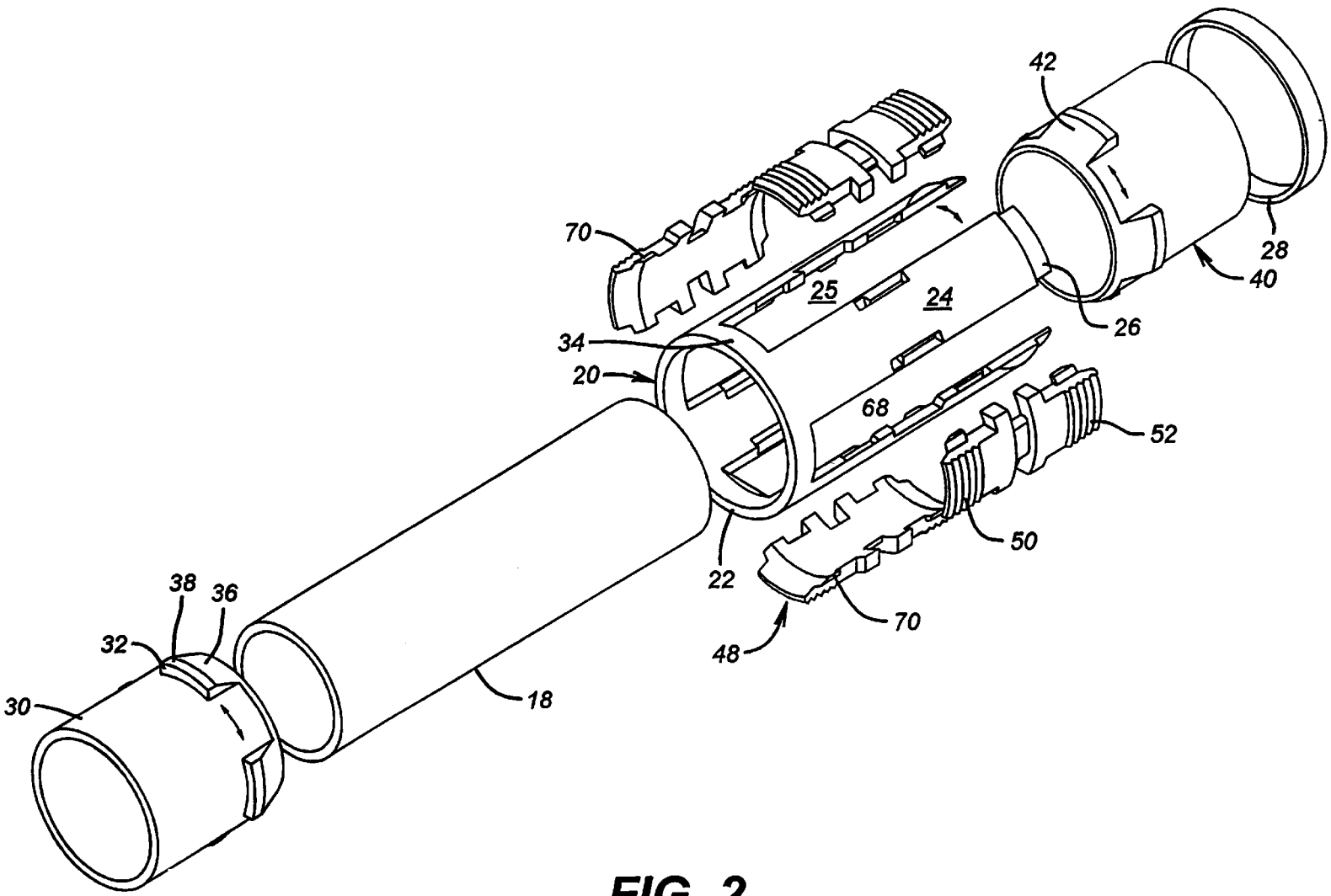
FIG. 2 is a perspective exploded view of the apparatus.
Figure 5A:
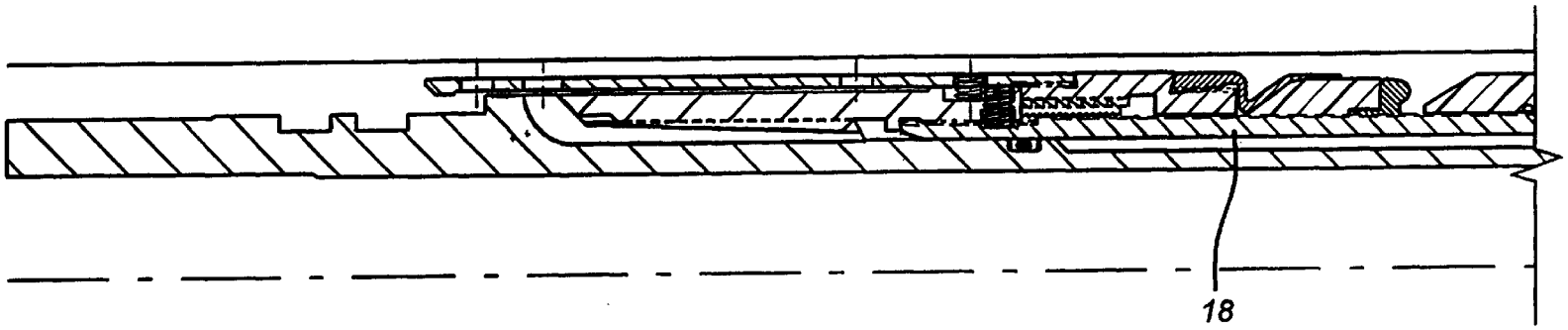
FIGS. 5*a*–5*b* are a sectional view of a packer using the slips of the present invention in the run-in position.
Figure 6A:
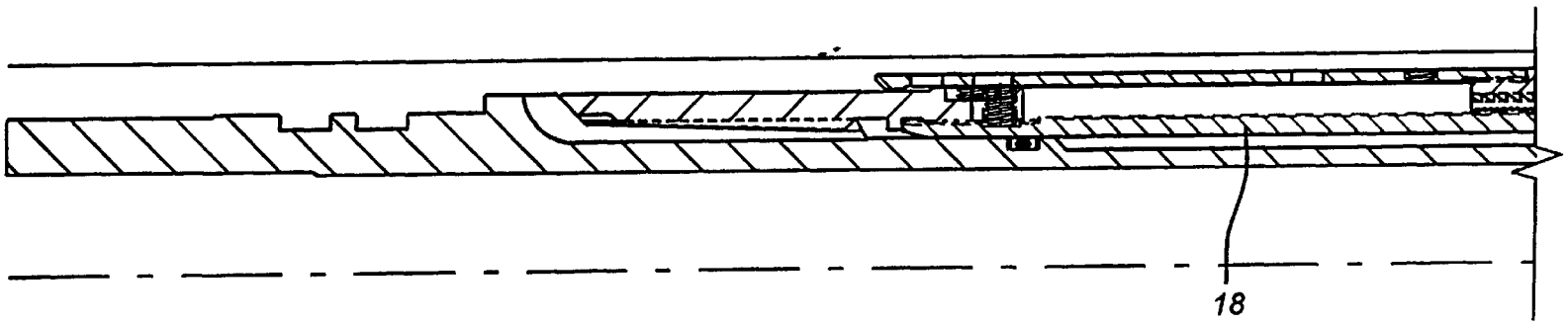
FIGS. 6*a*–6*b* are the same views as shown in FIGS. 5*a* and 5*b* with the slips in the set position.
Figure 5B:
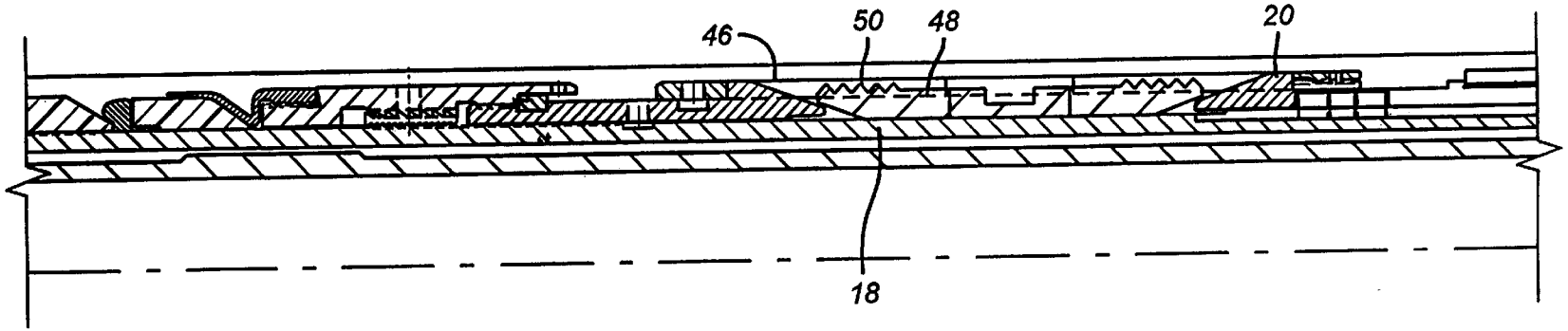
Figure 6B:
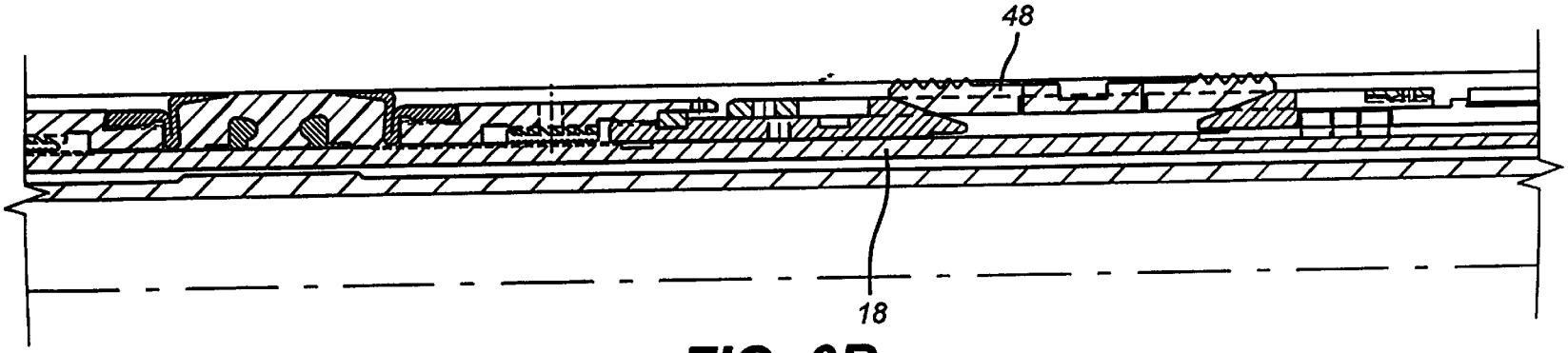
Figure 7A:
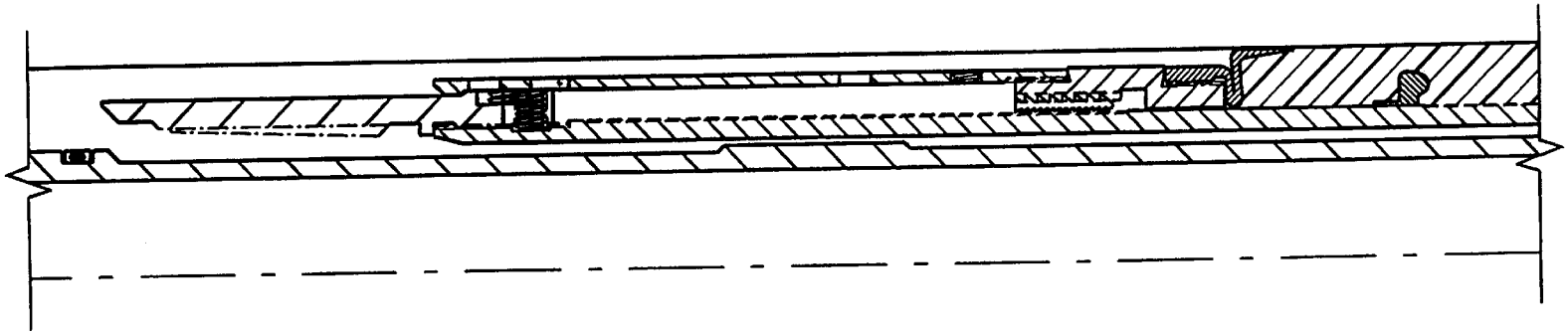
FIGS. 7*a* and 7*b* are the same views as FIGS. 6*a* and 6*b* with the slips now in the released position.
Figure 7B:
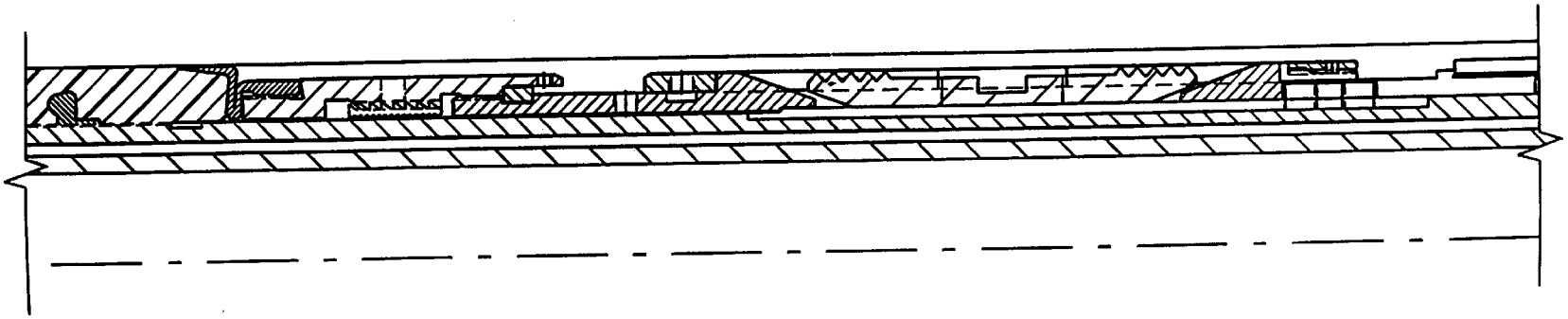

FIG. 2 illustrates the slip area of a downhole tool which in the preferred embodiments shown in FIGS. 5–7 is a packer. FIG. 2 illustrates the Mandrel 18 which can also be seen in FIG. 5*b*. The exploded view of FIG. 2 aids in understanding of how the assembly is put together and further aids in understanding of its operation. The cage 20 has a closed end 22 from which extend a series of longitudinal members 24 defining openings or windows 25. At their lower end 26, each of the longitudinal members 24 are threaded so as to accept a ring 28 in order to complete the assembly. Other mechanisms for attaching the ring 28 to the longitudinal members 24 are within the purview of the invention. To begin the assembly, cone 30 is initially inserted through lower end so that the shoulder 32 is retained by member 34 which forms a part of the closed end 22. As shown in FIG. 2, there are four discrete ramps 36, each having an outer dimension 38 with shoulder 32 defined adjacent thereto. The outer dimension 38 of the cone 30 is, at most, equal to, but can be smaller than, the outer dimension of the members 34 which define the closed end 22 of the cage 20.

Figure 3:
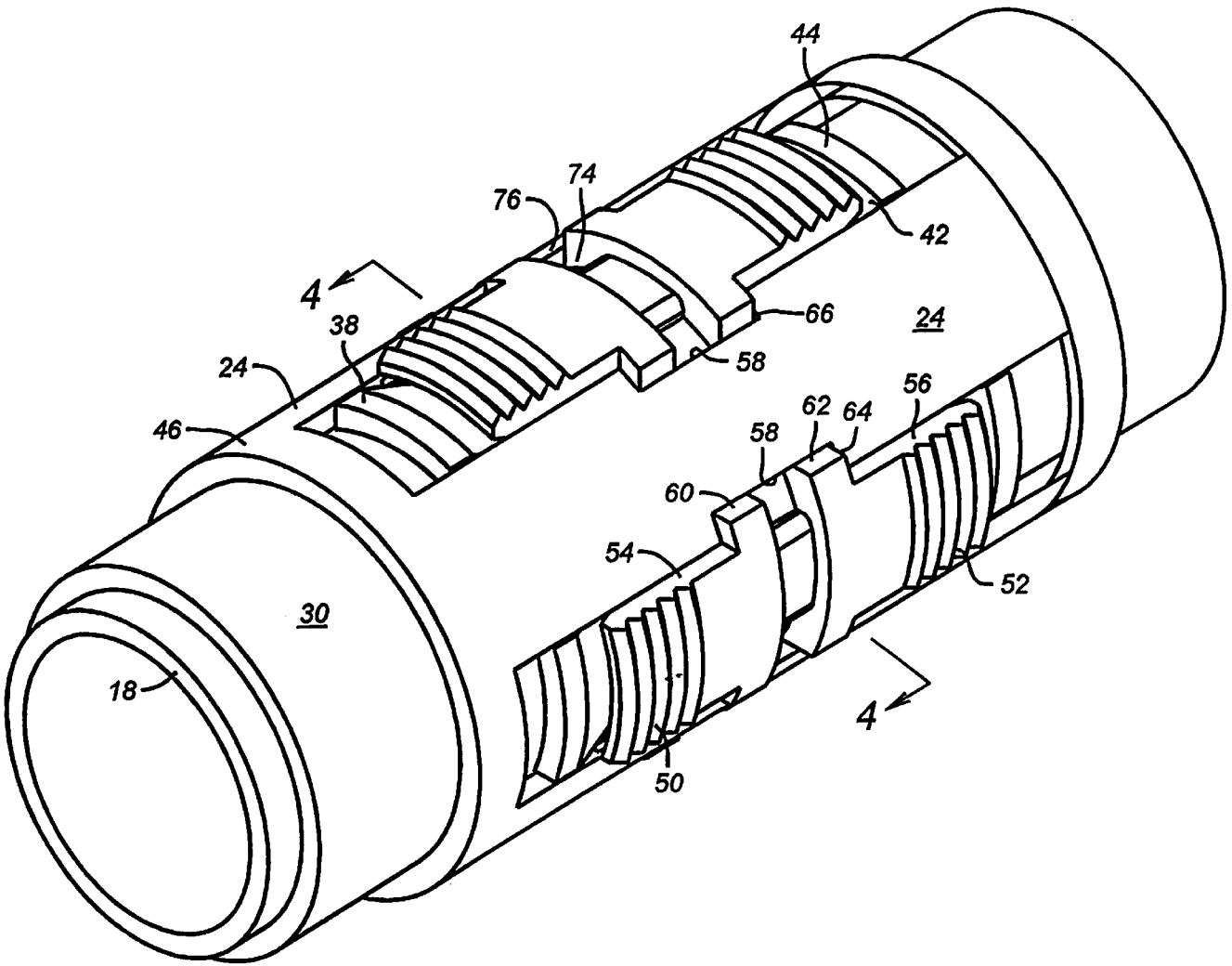
FIG. 3 is an assembled perspective view of the same apparatus.

With cone 30 inserted through the open end of cage 20 until shoulders 32 connect with members 34, the slips 48 are pushed into place and the mandrel 18 can now be installed through cones 30 and 40 which are already in place with respect to cage 20. Cone 40, which is preferably identical to cone 30 but in opposed orientation, slides over the mandrel 18 past lower end 26. Again, the tapers 42 extend in the gap between the longitudinal members 24 as shown in FIG. 3. The outer dimension 44 of the cone 40 is equal to the outer dimension of the members 24. FIG. 3 shows more clearly the extent of the outer dimension of cone 30 as being eqidistant with the outer surface 46 of the members 24 which define the cage 20. It could be shorter if desired.

Once cone 40 is installed over mandrel 18, ring 28 is threaded through lower end 26 and the assembly is complete as shown as FIG. 3.

As part of the assembly after installation of cone 30, the slips 48 (there being four shown in FIG. 2) are installed into the cage 20 prior to insertion of the mandrel 18. In the preferred embodiment, the slips 48 are all identical and, therefore, only one will be described with the understanding that the description is equally applicable to the remaining slips. However, it should be noted that it is within the purview of the invention to use slips of differing design and that only the preferred embodiment is intended to include identical slips laid out at 90° spacing about the longitudinal axis of the tool with opposed wickers. The slip 48 has opposed wickers 50 and 52 extending from opposed T-shaped bodies 54 and 56, respectively. A recess 58 is located on each side of each of the members 24 such that the extending tab sections 60 and 62 extend into recess 58 symmetrically on both sides of bodies 54 and 56. The recesses 58 clearly do not retain the bodies 54 and 56 against outward movement. Instead, the function of recesses 58 is in the retrieval of the downhole tool for effecting release of the slips 20. In essence, tabbed section 62 defines a pickup shoulder 64 which is engaged by a shoulder 66 (formed as part of recess 58) for release of the slips 20, as will be described below.

Referring again to FIG. 2, the members 24 each have an undercut 68 extending from opposed edges thereof. "Undercut" is a term meant to include open slots as shown or closed slots such as a grove disposed completely in the middle of the edge of members 24. This undercut engages a pair of opposed tabs 70 and this is the mechanism which limits the radial outward travel of the slips 48 as the tabs 70 come into contact with the end of the undercut 68. The assembled view of FIG. 3 does not show the tabs 70 and undercut 68 but they can be more readily seen in FIG. 2.

Thus, after cone 30 is inserted through the open end of cage 20 and all the slips 48 are inserted such that their tabs 70 are in undercut 68 and tabbed section 60 and 62 are within recess 58, the mandrel 18 is pushed through the cone 30 as the cone 40 is installed over the mandrel and the entire assembly is secured by ring 28.

Figure 4:
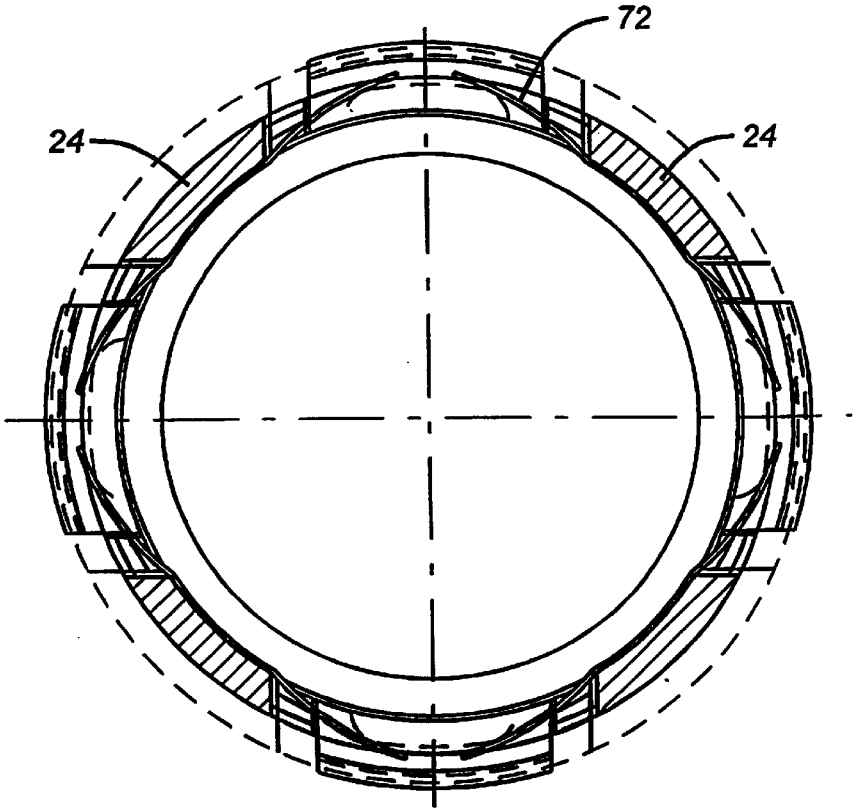
FIG. 4 is a section along lines 4—4 of FIG. 3.

The slips 48 are biased radially inwardly by band springs 72 which are more clearly shown in FIG. 4. It should be noted that the band springs have been deliberately omitted from FIGS. 2 and 3 for clarity of the drawings but are shown in the section view of FIG. 4. The band springs 72 span over a slip 48 generally in the area of recess 74 shown in FIG. 3. The springs 72 extend below the members 24 through apertures 76 which even at full extension of the slips 48 still leaves clearance so that the spring 72 is not cut as the slips 48 are forced out by the cones 30 and 40.

The operation of the caged slip assembly as depicted in FIGS. 2 and 3 is also shown in section in FIGS. 5 and 7. FIG. 5 is the run-in position which shows the slips 48 in a retracted position so that the wickers 50 do not extend beyond the outer dimension 46 of the cage 20. FIG. 6*b* illustrates the slips 48 in the extended position which is also shown in the perspective view of FIG. 3. Both cones move with respect to the slips. In order to accomplish this, in the known manner, by differential movement, the cone 40 is held stationary while the cone 30 is advanced toward it. This results in ramp 36 pushing out the slips 48 against tapers 42 of cone 40. As a result, the slips 48 move radially outwardly until they engage the casing (not shown) or until the tabs 70 engage their travel limits within undercut 68. The released position is shown in FIG. 7(*b*). This is accomplished by an upward force directed to cone 30 which forces shoulder 32 against member 34. The upward force applied to cone 30 pulls the tapered surface 36 out from under the slips 48 plus engages shoulder 32 to the cage 20 to impart an upward force on the cage 20. This in turn is transmitted to the slip assembly by virtue of shoulder 66 contacting pickup shoulder 64, which in turn pulls the slips 48 away from tapered surfaces 42 of cone 40.

Figure 1:
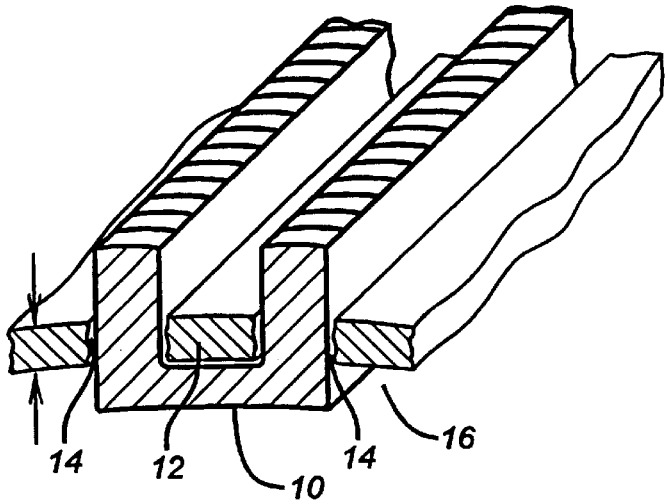
(PRIOR ART) FIG. 1
FIG. 1 is a perspective view of a prior art caged slip showing limitations of bearing load transmitted to the slips from the cones, as well as limitations of outer extension created by the design.

Those skilled in the art will appreciate the advantageous features of the disclosed design. The cones 30 and 40 have tapers 36 and 42 which extend to outer dimensions such as 38 which are at least equal to the outer dimension 46 of the cage 20. What this means is that the ramp surfaces 36 and 42 can bear over a greater area on the slips 48 and the amount of bearing area is not limited as in the prior art where the cone assembly in its entirety, including the ramp surfaces, was behind the openings 14 of the longitudinal members 12 which define the cage as shown in the prior art FIG. 1. Additionally, the use of the tabs 70 regulates the radial outward movement of the slips 48 in case they are extended to their maximum limit without encountering a segment of the casing.

With the design shown in FIGS. 2 and 3, the thickness of members 24 can vary to allow the appropriate structural strength to the cage assembly 20. However, varying the thickness of members 24 does not limit the outer travel available to the slips 48. The definition of the outer travel of the slips 48 is given by the depth and/or location of the undercut 68 and the position of the tabs 70 on the slips 48 in relation with the wickers 50. Since the members 24 already have larger recesses such as 58 to accommodate the slips 48, the undercut 68 can be varied so that a relatively thick cross-section of the members 24 can be employed while in discrete small areas an undercut 68 can be provided to allow significant radial movement of the slips 48. This versatility allows a single tool to be used in situations involving casings of different wall thicknesses as opposed to having on tap a variety of tools to be used depending on the particular casing size in which the slips 48 are to be set. Finally, the full advantages of protecting the slips 48 used in a caged design is retained while these other additional advantages are obtained. To further protect the slips 48 during run-in, the springs 72 hold them in a retracted position between the members 24. Thus, with the cones in effect being disposed in the windows defined between members 24, a greater load capacity of the slips 48 is achieved as the compact area on the slips 48 is increased. The cage 20 also serves as a transmission conduit for a pickup force which pulls the slips 48 off of tapers 42 on cone 40.

The foregoing disclosure and description of the invention are illustrative and explanatory thereof, and various changes in the size, shape and materials, as well as in the details of the illustrated construction, may be made without departing from the spirit of the invention.

What is claimed is:

1. A slip system for supporting a tool downhole, comprising:

a tool body;

a slip cage mounted to said tool body defining at least one opening and having a predetermined outside diameter;

at least one slip movably mounted in said opening;

at least one cone, said cone having a sloping surface to engage said slip, said sloping surface of said cone extending into said opening.

2. A slip system for supporting a tool downhole, comprising:

a tool body;

a slip cage mounted to said tool body defining at lease one opening and having a predetermined outside diameter:

at least one slip movably mounted in said opening;

at least one cone, said cone having a sloping surface to engage said slip, said sloping surface of said cone extending into said opening;

said slip cage comprises a longitudinal axis and said opening is defined between a plurality of longitudinally extending members;

said slip further comprises at lest one first tab which defines the outward travel limit of said slip when it contacts one of said longitudinally extending members.

3. The system of claim 2, wherein:

said longitudinally extending members comprise an undercut adjacent said opening, said first tab on said slip disposed in said undercut.

4. The system of claim 3, wherein:

said longitudinally extending members comprise a recess;

said slip comprises at least one second tab extending into said recess to facilitate longitudinal movement of said slip by said cage relative to said cone.

5. The system of claim 4, further comprising:

a biasing member acting on said slip to urge it inwardly toward said longitudinal axis.

6. The system of claim 1, wherein:

said sloping surface extends outwardly into said opening to a dimension as great as said predetermined outside diameter of said slip cage.

7. The system of claim 6, wherein:

said sloping surface extends outwardly into said opening as far as said outside diameter of said slip cage.

8. The system of claim 6, wherein:

said at least one opening further comprises a plurality of openings defined by longitudinally extending members;

said at least one slip and said at least one cone further comprise a plurality of slips with at least one slip in each said opening and at least one cone having a sloping surface in each said opening to engage said slip;

said sloping surfaces separated circumferentially from each other so that they straddle said longitudinally extending members while extending into said openings.

9. The system of claim 8, wherein:

said at least one cone comprising an upper and a lower cone mounted on either end of said slip, such that the respective sloping surfaces of said cones can selectively contact said slips for outward movement through said openings.

10. A slip system for supporting a tool downhole, comprising:

a tool body:

a slip cage mounted to said tool body defining at lease one opening and having a predetermined outside diameter;

at least one slip movably mounted in said opening;

at least one cone, said cone having a sloping surface to engage said slip, said sloping surface of said cone extending into said opening;

said sloping surface extends outwardly into said opening to a dimension as great as said predetermined outside diameter of said slip cage;

said at least one opening further comprises a plurality of openings defined by longitudinally extending members;

said at least one slip and said at least one cone further comprise a plurality of slips with at least one slip in each said opening and at least one cone having a sloping surface in each said opening to engage said slip;

said sloping surfaces separated circumferentially from each other so that they straddle said longitudinally extending members while extending into said openings;

said at least one cone comprising an upper and a lower cone mounted on either end of said slip, such that the respective sloping surfaces of said cones can selectively contact said slips for outward movement through said openings;

said slip comprises at least one first tab which defines the outward travel limit of said slip when it contacts one of said longitudinally extending members.

11. The system of claim 10, wherein:

said longitudinally extending members comprise undercuts such that each opening has two opposed undercuts;

said at least one first tab comprises a pair of tabs on said slips disposed in said undercut to limit outward movement of said slips through said openings.

12. The system of claim 11, wherein:

the thickness of said longitudinally extending members does not limit outer travel of said slips, said outer travel limit defined by engagement of said first tabs in said undercuts.

13. The system of claim 12, wherein:

said longitudinally extending members comprise recesses such that each opening has two opposed recesses;

said slips comprise opposed second tabs extending into said recesses;

said cage engageable to said slips through said recesses engaging said second tabs to longitudinally shift said slips away from said lower cone.

14. The system of claim 13, wherein:

said upper cone comprising a shoulder adjacent its sloping surfaces which is engageable to said slip cage, whereupon translation of said upper cone, in tandem with said slip cage, pulls said slips away from said lower cone.

15. The system of claim 14, wherein:

a biasing member acting on each slip to bias said slips internally into said openings.

16. The system of claim 15, further comprising:

wickers in opposed orientations on said slips.

17. The system of claim 3, wherein:

said undercut is sufficiently deep so as to allow said slip sufficient outward travel range through said opening such that all wall thicknesses of a given size tubular can be engaged by said slips mounted in said tool body.

* * * * *